US009688929B2

(12) United States Patent
Regrut

(10) Patent No.: US 9,688,929 B2
(45) Date of Patent: Jun. 27, 2017

(54) COMPOSITION FOR SURFACE VOLTAGE REDUCTION IN DISTILLATE FUEL

(71) Applicant: AFTON CHEMICAL CORPORATION, Richmond, VA (US)

(72) Inventor: Jon A. Regrut, Richmond, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 49 days.

(21) Appl. No.: 14/938,899

(22) Filed: Nov. 12, 2015

(65) Prior Publication Data

US 2016/0160140 A1 Jun. 9, 2016

Related U.S. Application Data

(60) Provisional application No. 62/089,299, filed on Dec. 9, 2014.

(51) Int. Cl.

| | |
|---|---|
| ***C10L 1/00*** | (2006.01) |
| ***C10L 1/14*** | (2006.01) |
| ***C10L 10/00*** | (2006.01) |
| ***C10L 1/2383*** | (2006.01) |
| *C10L 1/22* | (2006.01) |
| *C10L 1/24* | (2006.01) |
| *C10L 1/16* | (2006.01) |
| *C10L 1/222* | (2006.01) |
| *C10L 1/236* | (2006.01) |
| *C10L 1/238* | (2006.01) |
| *C10L 1/26* | (2006.01) |

(52) U.S. Cl.

CPC ..... *C10L 1/143* (2013.01); *C10L 1/2383* (2013.01); *C10L 10/00* (2013.01); *C10L 1/1616* (2013.01); *C10L 1/221* (2013.01); *C10L 1/2225* (2013.01); *C10L 1/238* (2013.01); *C10L 1/2364* (2013.01); *C10L 1/2437* (2013.01); *C10L 1/2475* (2013.01); *C10L 1/2641* (2013.01); *C10L 2200/0446* (2013.01); *C10L 2230/20* (2013.01); *C10L 2270/026* (2013.01); *C10L 2290/24* (2013.01); *C10L 2300/20* (2013.01); *C10L 2300/40* (2013.01)

(58) Field of Classification Search

CPC ..... C10L 1/143; C10L 10/00; C10L 1/2383; C10L 1/221; C10L 2230/20; C10L 2270/026; C10L 2290/24; C10L 1/2437; C10L 1/2475; C10L 2300/40; C10L 2200/0446; C10L 1/1616; C10L 1/2225; C10L 1/2364; C10L 1/238; C10L 1/2641; C10L 2300/20

See application file for complete search history.

(56) References Cited

U.S. PATENT DOCUMENTS

| | | | | |
|---|---|---|---|---|
| 3,578,421 | A | 5/1971 | Andress et al. | |
| 3,811,848 | A | 5/1974 | Johnson | |
| 3,917,466 | A | 11/1975 | Henry, Jr. | |
| 4,416,668 | A | 11/1983 | Thompson | |
| 8,876,921 | B2 * | 11/2014 | McRobbie | C10L 1/143 44/355 |
| 2005/0039384 | A1 | 2/2005 | Gormley | |
| 2005/0183325 | A1 | 8/2005 | Sutkowski | |
| 2007/0220803 | A1 | 9/2007 | Henry, Jr. | |
| 2008/0256848 | A1 | 10/2008 | Brennan et al. | |
| 2010/0072427 | A1 | 3/2010 | Posselt et al. | |
| 2014/0318002 | A1 | 10/2014 | Posselt et al. | |

FOREIGN PATENT DOCUMENTS

WO 2013007994 A1 1/2013

OTHER PUBLICATIONS

Henry Jr., C. P., "Electrostatic Hazards and Conductivity Additives," National Fuels and Lubricants Meeting, Nov. 5-6, 1992, FL-92-116, pp. 1-12, Houston, TX.

* cited by examiner

*Primary Examiner* — Cephia D Toomer

(74) *Attorney, Agent, or Firm* — Luedeka Neely Group, PC

(57) ABSTRACT

Additive composition mixtures and methods for synergistically maintaining low surface voltages of distillate fuels that include a synergistic conductivity improver additive composition for a distillate fuel. The additive composition includes: A) a mixture of (i) alkenyl polysulfone polymer, (ii) C16-C24 substituted maleic/polyamine copolymer, (iii) sulfonic acid, and (iv) aromatic solvent; and B) a mixture of (i) alkenyl polysulfone polymer, (v) polymeric reaction product of a C8-C18 aliphatic amine or diamine with epichlorohydrin; (iii) sulfonic acid, (iv) aromatic solvent; and optionally (vi) a quaternary ammonium compound. The additive composition contains from 30 to 60 wt. % component (A) and from 30 to 60 wt. % component (B) based on a total weight of the additive composition.

16 Claims, No Drawings

COMPOSITION FOR SURFACE VOLTAGE REDUCTION IN DISTILLATE FUEL

RELATED APPLICATION

This application claims priority to provisional application Ser. No. 62/089,299, filed Dec. 9, 2014.

TECHNICAL FIELD

The disclosure is directed to compositions and methods for maintaining low surface voltages of fuel as storage tanks, such as aircraft wing tanks are being filled to reduce the risk of static discharge and incendiary events. In particular, the disclosure relates to a synergistic combination of static dissipating additives and distillate fuel compositions containing the synergistic combination of additives.

BACKGROUND AND SUMMARY

Static Dissipating additives are used in many distillate fuels, including diesel, aviation turbine (jet) fuels, and gasoline, to reduce the risk of static charges being built up in a fuel as it flows through pipes and high surface area filters. The built up of static charges can approach 100 kV and even with proper bonding and grounding it is possible for static discharges to occur resulting in fires and explosions. In general the energy of a discharge must be over 1 kV (or under −1 kV) for a localized discharge or 30 kV (or under −30 kV) for a brush discharge to be incendiary to distillate fuels. In aviation fuels there is currently only a single approved static dissipating additive for maintaining low surface voltages and for increasing voltage relaxation rates of a fuel. A combination of conductivity additive is not only discouraged by regulation in aviation fuels but requires extensive testing to show that any new or additional additive to an aviation fuel does not counteract or adversely affect any other additive in the fuel. Accordingly, the only approved conductivity additive for aviation fuel is an additive that is a combination of polysulfone/amine epichlorohydrin polymer in combination with sulfonic acid, a quaternary ammonium, and an aromatic solvent.

It is known that trace materials in hydrocarbon fuels such as acids, alcohols, amines, and mercaptans enables the fuel to be much more easily ionized to give electrically charged fragments than the pure, unadditized fuel. Unfortunately, many of the foregoing compounds and other impurities are always present in fuels, thus the overall tendency of the fuel to generate charge is not predictable and varies at least 100-fold. The magnitude of charge generated also depends on flow velocity. Thus fine filters, such as filter-coalescers can give enormous electrostatic charging because of the huge surface area compared to pipes and fittings. Static charges can also build up rapidly on the surface of fuel in tanks. Because of the unknown level of impurities in a fuel, there is a need to maintain a low fuel surface voltage without adversely affecting the conductivity or surface voltage relaxation time of the fuel.

In view of the foregoing, embodiments of the disclosure provide additive composition mixtures and methods for synergistically maintaining low surface voltages of distillate fuels. In one embodiment there is provided a synergistic conductivity improver additive composition for a distillate fuel. The additive composition includes: A) a mixture of (i) alkenyl polysulfone polymer, (ii) $C_{16}$-$C_{24}$ substituted maleic/polyamine copolymer, (iii) sulfonic acid, and (iv) aromatic solvent; and B) a mixture of (i) alkenyl polysulfone polymer, (v) polymeric reaction product of a $C_8$-$C_{18}$ aliphatic amine or diamine with epichlorohydrin; (iii) sulfonic acid, (iv) aromatic solvent; and optionally (vi) a quaternary ammonium compound. The additive composition contains from 30 to 60 wt. % component (A) and from 30 to 60 wt. % component (B) based on a total weight of the additive composition.

In another embodiment, there is provided a method for synergistically maintaining an absolute value of surface voltage of a distillate fuel below 1000 volts. The method includes providing a distillate fuel and adding to the fuel A) from about 0.25 to about 2.5 mg/L by weight based on a total volume of the fuel composition of a mixture of (i) alkenyl polysulfone polymer, (ii) hydrocarbyl substituted maleic/polyamine copolymer, (iii) sulfonic acid, and (iv) aromatic solvent; and B) from about 0.25 to about 2.5 mg/L by weight based on a total volume of the fuel composition of a mixture of (i) alkenyl polysulfone polymer, (v) polymeric reaction product of a $C_8$-$C_{18}$ aliphatic amine or diamine with epichlorohydrin; (iii) sulfonic acid, (iv) aromatic solvent; and optionally (vi) a quaternary ammonium compound.

Yet another embodiment provides a method for synergistically maintaining an absolute value of surface voltage of a distillate fuel below 1000 volts. The method includes: providing a first distillate fuel and adding to the first fuel a fuel additive (A) comprising from about 0.25 to about 2.5 mg/L by weight based on a total volume of the first fuel composition of a mixture of (i) alkenyl polysulfone polymer, (ii) hydrocarbyl substituted maleic/polyamine copolymer, (iii) sulfonic acid, and (iv) aromatic solvent; providing a second distillate fuel and adding to the second fuel a fuel additive (B) comprising from about 0.25 to about 2.5 mg/L by weight based on a total volume of the second fuel composition of a mixture of (i) alkenyl polysulfone polymer, (v) polymeric reaction product of a $C_8$-$C_{18}$ aliphatic amine or diamine with epichlorohydrin; (iii) sulfonic acid, (iv) aromatic solvent; and optionally (vi) a quaternary ammonium compound; and mixing the first fuel and the second fuel in a volume ratio of 0.1:1 to 10:1.

Another embodiment of the disclosure provides a distillate fuel composition that includes a major amount of distillate fuel and minor conductivity improving amount of: A) a mixture of (i) alkenyl polysulfone polymer, (ii) $C_{16}$-$C_{24}$ substituted maleic/polyamine copolymer, (iii) sulfonic acid, and (iv) aromatic solvent; and B) a mixture of (i) alkenyl polysulfone polymer, (v) polymeric reaction product of a $C_8$-$C_{18}$ aliphatic amine or diamine with epichlorohydrin; (iii) sulfonic acid, (iv) aromatic solvent; and optionally (vi) a quaternary ammonium compound.

An advantage of the embodiments of the disclosure is that a fuel, particularly an aviation or jet fuel may be maintained at a synergistically low surface voltage while not adversely affecting the conductivity or voltage relaxation time of the fuel. The synergistically low surface voltage achieved by the presence of two different types of amine polymers from conductivity improving additives was surprising and quite unexpected. In generally, a mixture of polysulfone and amine polymer effectively raises conductivity and increase charge relaxation rates, but may also increase the amount of charge generated when a fuel passes through pipes and filters. The magnitude and direction of the charge (i.e. positive or negative) is determined by pipe material, plastic versus metal, inherent fuel properties, and the additives used. Traditional conductivity additives contain a polysulfone and an epichlorohydrin/diamine polymer. However, a fuel that includes polysulfone and the two different amine polymers described herein provides a lower surface voltage than can be achieved by a conductivity additive or fuel containing only one of the amine polymers. Depending on the formulation of the additive the fuel may have an overall negative or positive net charge.

DETAILED DESCRIPTION OF EXEMPLARY EMBODIMENTS

As used herein, "middle distillate fuel" is understood to mean one or more fuels selected from the group consisting of diesel fuel, biodiesel, biodiesel-derived fuel, synthetic fuels, jet fuels, kerosene, diesel fuel treated with oxygenates for particulate control, mixtures thereof, and other products meeting the definitions of ASTM D975. As used herein, "biodiesel" is understood to mean diesel fuel comprising fuel derived from biological sources such as biomass to liquid (BTL) fuels. Synthetic fuels include, but are not limited to fuels produced from coal such as coal to liquid (CTL) fuels and natural gas, such as gas to liquid (GTL) fuels as well as other synthetic routes including bio-alcohols-to-jet (ATJ), and hydrogenated ester of fatty acids (HEFA) fuels. In an aspect, the middle distillate fuel can contain up to 50%, for example from about 0.5% to about 30%, such as from about 10% to about 20%, fuel derived from biological sources and/or synthetic fuel sources.

The middle distillate fuel can be derived from biological sources such as oleaginous seeds, for example rapeseed, sunflower, soybean seeds, and the like. The seeds can be submitted to grinding and/or solvent extraction treatments (e.g., with n-hexane) in order to extract the oil, which comprises triglycerides of saturated and unsaturated (mono- and poly-unsaturated, in mixture with each other, in proportions depending on the selected oleaginous seed) $C_{16}$-$C_{22}$ fatty acids. The oil can be submitted to a filtration and refining process, in order to remove any possible free fats and phospholipids present, and can be submitted to a trans-esterification reaction with methanol in order to prepare the methyl esters of the fatty acids (fatty acid methyl esters, also known as "FAME" and commonly referred to as biodiesel.)

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt % relative to the total weight of the composition. Moreover, as used herein, the term "minor amount" is understood to mean an amount less than 50 wt. % relative to the total weight of the composition.

Component (i)

The alkenyl polysulfone polymers often designated as olefin-sulfur dioxide copolymer, olefin polysulfones, or poly (olefin sulfone) are linear polymers wherein the structure is considered to be that of alternating copolymers of the olefins and sulfur dioxide, having a one-to-one molar ratio of the comonomers with the olefins in head to tail arrangement. The polysulfone polymers used herein are readily prepared by the methods known in the art.

The weight average molecular weights of the polysulfone polymers are in the range from about 10,000 to 1,500,000, with the preferred range being from about 50,000 to 900,000, and the most preferred molecular weights being in the range of from about 100,000 to 500,000 Daltons. Polysulfone polymers whose molecular weights are below about 10,000, while effective in increasing conductivity in hydrocarbon fuels, do not increase the conductivity values as much as polysulfone polymers of higher molecular weights. Polysulfone polymers whose molecular weights are above about 1,500,000 are difficult to produce and are more difficult to handle.

The control of the molecular weights of the polysulfone polymers in the desired range is readily accomplished by those skilled in the art of polymer science by controlling the polymerization conditions such as the amount of initiator used, polymerization temperature and the like or by using molecular weight modifiers such as dodecyl mercaptan. The amount of molecular weight modifier required to obtain the desired molecular weight range will depend upon the particular 1-olefin being polymerized with sulfur dioxide, and can be determined easily with few experiments. Generally, the amount of modifier, such as dodecyl mercaptan, used to obtain the molecular weights in the range of 50,000 to 900,000 is in the range of up to about 0.007 mole per mole of 1-olefin.

The 1-alkenes useful for the preparation of the polysulfone polymers are available commercially as pure or mixed olefins from petroleum cracking processes or from the polymerization of ethylene to a low degree. Included are 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonodecene, 1-eicosene, 1-heneicosene, 1-docosene, 1-tricosene and 1-tetracosene. Although branched-chain alkenes are useful, the straight-chain 1-alkenes are preferred whether pure or in admixture with other straight-chain 1-alkenes.

When the polysulfone polymer contains up to 10 mol percent of the olefin AHC═CHB, A and B can together form a dicarboxylic anhydride group. The dicarboxylic anhydride group is readily converted to two carboxyl groups by simple acid hydrolysis. The olefin, AHC═$CH_2$, is a terminally unsaturated alkenoic acid represented by $CH_2$═CH—($C_xH_{2x}$)—COOH. The alkylene group bridging the vinyl and the carboxyl groups can have from 1 to 17 carbon atoms or it can be absent, and such alkylene group when present can be straight chain group or branched chain. The useful acids are alkenoic acids of 3 to 20 carbon atoms wherein the olefinic group is a terminal group. Representative but non-limiting examples of alkenoic acids with a terminal olefinic group include acrylic acid, 3-butenoic acid, 4-pentenoic acid, 5-hexenoic acid, 6-heptenoic acid, 7-octenoic acid, 8-nonenoic acid, 9-decenoic acid, 10-undecenoic acid, 11-dodecenoic acid, 13-tetradecenoic acid, 15-hexadecenoic acid, 17-octadecenoic acid as well as branched chain alkenoic acids with terminal olefinic groups such as 2-ethyl-4-pentenoic acid, 2,2-dimethyl-4-pentenoic acid, 3-ethyl-6-heptenoic acid, 2-ethyl-6-heptenoic acid, 2,2-dimethyl-6-heptenoic acid and the like. It should be understood that a mixture of alkenoic acids may be used.

The reaction leading to polysulfone formation is the art-known free-radical polymerization process. Nearly all types of radical initiators are effective in initiating polysulfone formation. Radical initiators such as oxygen, ozonides, t-butylperoxypivalate, hydrogen peroxide, ascaridole, cumene peroxide, benzoyl peroxide, azobisisobutyronitrile are examples of some of the useful initiators. Free-radicals are generated from such radical initiators either thermally and/or by light activation in the presence of a mixture of sulfur dioxide and 1-alkene. The polymerization is typically carried out in liquid phase, conveniently in a solvent such as benzene, toluene or xylene to facilitate the reaction. Such solvent may be removed, e.g., by distillation, if desired, but it is generally more convenient to use the polysulfone copolymer as a concentrate in such solvent. Generally, it is preferable to use an excess of sulfur dioxide since any unreacted sulfur dioxide is readily removed, as by passing nitrogen gas into the polymer solution. An excess of 1-alkene may be used, however, and the excess subsequently removed as by distillation.

The particular molar ratio of 1-alkene to sulfur dioxide appears to be immaterial since the resultant polysulfone polymer contains 1-alkene and sulfur dioxide in 1:1 molar ratio regardless of the particular molar ratio reacted. However, for efficiency in utilization of the reactants and of the equipment, a slight excess of sulfur dioxide is preferred. The polymerization may be carried out at atmospheric or superatmospheric pressures, the polymerization reaction being independent of the pressure. The polymerization temperature may be any convenient temperature below the ceiling temperature of the particular 1-alkene employed. Ceiling temperature is the temperature at which the rates of polymerization and depolymerization are equal so that no polymer formation takes place. Generally, the convenient polymerization temperature range is from about 0 to 50° C.

Each of the components (A) and (B) described above may contain from about 10 to about 20% by weight of the polysulfone polymer based on a total weight of each component.

Component (ii)

The compound of component (ii) includes a polymeric material containing one or more basic nitrogen atoms and at least one relatively long-chain branched or linear hydrocarbon radical having at least 4 carbon atoms. In one embodiment, the hydrocarbon radical has at least 8 carbon atoms, suitable at least 12 carbon atoms, in particular from 16 to 50 carbon atoms. The compound of component (ii) is substantially devoid of hydroxyl groups.

The relatively long-chain branched or linear hydrocarbon radical may be on the basic nitrogen atom or on one of the basic nitrogen atoms or on a carbon atom, especially on a carbon atom of the main polymer chain in polymeric structures. Suitable oligomeric or polymeric structure types for component (ii) with such relatively long-chain hydrocarbon radicals are, include, but are not limited to, reaction products of oligoethyleneamines or oligoethyleneimines with alkyl halides, polyethyleneimines with polyisobutenylsuccinic anhydrides, ethylene-vinyl acetate-amino(meth)acrylate terpolymers and especially olefin-maleic anhydride copolymers derivatized with polyamines, in particular α-olefin-maleimide copolymers having at least one basic nitrogen atom.

A typical example of a reaction product of an oligoethyleneamine with an alkyl halide is the reaction product of comb-like structure formed from decaethyleneundecamine and a multiple molar excess of n-hexadecyl chloride.

The structure and the preparation process for the α-olefin-maleimide copolymers with at least one basic nitrogen atom of component (ii) are described in principle in document U.S. Pat. No. 4,416,668. In a one embodiment, the α-olefin-maleimide copolymers are obtainable by free-radical polymerization of one or more linear or branched α-olefins having from 6 to 50 carbon atoms with maleic anhydride and subsequent reaction with one or more polyamines. The α-olefin-maleic anhydride copolymers and the α-olefin-maleimide copolymers prepared therefrom are typically 1:1 copolymers alternating in the main polymer chain, in which one maleic acid unit always follows one α-olefin unit. As a result of the relatively long-chain branched or linear hydrocarbon radicals, comb structures generally arise.

Useful branched and especially linear 1-olefins having from 6 to 50 carbon atoms for preparing the α-olefin-maleimide copolymers of component (ii) are, for example, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octa-decene, 1-nonadecene, 1-eicosene, 1-heneicosene, 1-docosene, 1-tricosene, 1-tetracosene, 1-triacontene, 1-tetracontene, 1-pentacontene or mixtures thereof. Particular preference is given to linear 1-olefins having from 12 to 30 carbon atoms, especially having from 16 to 24 carbon atoms, and mixtures thereof.

The free-radical polymerization of the 1-olefins with maleic anhydride is performed by the customary methods. For this purpose, the customary free-radical initiators are used, especially those based on peroxides or azo compounds, for example di-tert-butyl peroxide, tert-butyl peroxypivalate or azobisisobutyronitrile, the customary temperature and pressure ranges are employed, for example from 50 to 150° C. at standard pressure, and the reactions are performed in the customary solvents, for example aromatic hydrocarbons. The solvents used are preferably the high-boiling organic solvents of component (iv) described below.

On completion of polymerization, the resulting α-olefin-maleic anhydride copolymers are reacted with one or more polyamines to give the corresponding imide. Polyamines with a primary amino group are required for the imide formation, and at least one further primary, secondary or tertiary amino group for the basic nitrogen atom. Suitable examples in this context are relatively short-chain diamines such as ethylenediamine, 1,3-propylenediamine, 3-(N,N-dimethylamino)propylamine ("DMAPA") or bis[3-(N,N-dimethylamino)propyl]amine ("bis-DMAPA") or relatively long-chain diamines such as tallow fat-1,3-diaminopropane. The customary reaction conditions for this imide formation are known to those skilled in the art. When solvents are additionally used for this imide formation, preference is given to using the high-boiling organic solvents of component (iv).

Typical examples of α-olefin-maleic anhydride copolymers reacted with aliphatic polyamines are the reaction products which have a comb-like structure formed from $C_{16/24}$-α-olefin maleic anhydride copolymers and 3-(N,N-dimethylamino)propylamine ("DMAPA") or bis[3-(N,N-dimethylamino)propyl]amine ("bis-DMAPA").

The described α-olefin-maleimide copolymers having at least one basic nitrogen atom of component (ii) typically have a weight-average molecular weight Mw of from 500 to 50,000, especially from 1000 to 10,000 Daltons. A typical α-olefin-maleimide copolymer is an α-olefin-maleic anhydride copolymer which has been reacted with tallow fat-1, 3-diaminopropane to give the imide and has a weight-average molecular weight Mw in the range from 1000 to 10,000 Daltons.

The amount of component (ii) in component (A) may range from about 8 to about 15% by weight based on a total weight of component (A).

Component (iii)

The sulfonic acid component is preferably an organic sulfonic acid which, to achieve the oil solubility, appropriately has a relatively long-chain or relatively voluminous hydrocarbyl radical, especially having from 6 to 40 carbon atoms, in particular from 8 to 32 carbon atoms, more preferably having from 10 to 24 carbon atoms. Suitable hydrocarbyl radicals may be linear or branched alkyl or alkenyl radicals, e.g. n-hexyl, n-heptyl, n-octyl, 2-ethylhexyl, n-nonyl, n-decyl, 2-propylheptyl, n-undecyl, n-dodecyl, n-tridecyl, isotridecyl, n-tetradecyl, n-pentadecyl, n-hexadecyl, n-heptadecyl, n-octadecyl, n-nonadecyl, n-eicosyl, n-heneicosyl, n-docosyl, n-tricosyl, n-tetracosyl, oleyl, linolyl or linolenyl, cycloalkyl radicals, e.g. cyclohexyl, methyl-cyclohexyl or dimethylcyclohexyl, aryl radicals, e.g. phenyl or naphthyl, aralkyl radicals, e.g. benzyl or 2-phenylethyl, or more preferably alkaryl radicals, especially phenyl or naphthyl substituted by linear or branched $C_1$- to $C_{18}$-alkyl groups, e.g. tolyl, xylyl, n-nonylphenyl, n-decylphenyl, n-dodecylphenyl, isotridecylphenyl, n-nonylnaphthyl, di-n-nonylnaphthyl, n-decylnaphthyl, di-n-decylnaphthyl, n-dodecylnaphthyl, di-n-dodecylnaphthyl, isotridecylnaphthyl or diisotridecylnaphthyl. In the latter monosubstituted phenyl radicals, the alkyl groups may be in the ortho, meta or para position to the sulfonic acid group, preference being given to para orientation. Typical examples of component (iii) are therefore n-nonylbenzenesulfonic acid, n-decyl-benzenesulfonic acid, n-dodecylbenzenesulfonic acid, isotridecylbenzenesulfonic acid, n-nonylnaphthylsulfonic acid, di-n-nonylnaphthylsulfonic acid, n-decylnaphthylsulfonic acid, di-n-decylnaphthylsulfonic acid, n-dodecylnaphthylsulfonic acid, di-n-dodecyl-naphthylsulfonic acid, isotridecylnaphthylsulfonic acid and diisotridecylnaphthylsulfonic acid.

In addition to the organic sulfonic acids mentioned, it is also possible in principle to use, as component (iii), for example, oil-soluble organic sulfinic acids or organic phosphonic acids which likewise appropriately have a relatively long-chain or relatively voluminous hydrocarbyl radical, especially one having from 6 to 40 carbon atoms, in particular from 8 to 32 carbon atoms, more preferably having from 10 to 24 carbon atoms.

When formulating concentrates, it is preferred that the polymeric polyamine be present as a salt, particularly a sulfonic acid salt, for improved resistance to precipitate formation in storage. For example, when a concentrate as described comprising polymeric polyamine in the free base form is stored at elevated temperatures of about 44° C. for a period of time of about 4 weeks, a small amount of precipitate sometimes forms. The presence of small amounts of precipitate in the concentrates has little or no effect on the usefulness of the present compositions as antistatic additives but is undesirable if only from an aesthetic point of view. It has been found that strong acids such as hydrochloric, sulfuric or a sulfonic acid can be used to limit precipitate formation in the concentrates. Oil-soluble sulfonic acids are preferred because they effectively inhibit precipitate formation without substantial deleterious effect upon the electrical conductivity property of the composition. Any oil-soluble sulfonic acid such as an alkanesulfonic acid or an alkarylsulfonic acid may be used. A useful sulfonic acid is petroleum sulfonic acid resulting from treating oils with sulfuric acid.

Generally, the amount of sulfonic acid incorporated in the concentrate is an equivalent amount, that is, sufficient amount of sulfonic acid to neutralize all the amine groups of the polymeric polyamine, although lesser or greater than the equivalent amount can be used.

Each of the components (A) and (B) described above may contain from about 5 to about 15% by weight of the sulfonic acid component based on a total weight of each component.

Component (iv)

The aromatic solvent of component (iv) is not an active component of the additive formulation for surface voltage reduction or improving the conductivity of a fuel, but, through its interaction with components (i), (ii), (iii), (v) and (vi), promotes an enhances its action, contributes to the thermal stability of the formulation and ensures a relatively high flashpoint.

In a one embodiment, component (iv) consists to an extent of from at least 80% by weight, in particular to an extent of at least 90% by weight, of a high-boiling aromatic hydrocarbon having from 9 to 30 carbon atoms or a mixture of such high-boiling aromatic hydrocarbons. Most preferably, component (iv) is, to an extent of at least 80% by weight, especially to an extent of at least 90% by weight, in particular to an extent of 100% by weight, a mixture of high-boiling aromatic hydrocarbons having from 9 to 20 carbon atoms, especially from 9 to 14 carbon atoms. Such aromatic hydrocarbons are in particular bicyclic, tricyclic or polycyclic aromatics, for example naphthalene, diphenyl, anthracene or phenanthrene, or mono-, bicyclic, tricyclic or polycyclic aromatics with aliphatic side chains, for example substituted benzenes with $C_7$- to $C_{14}$-alkyl side chains, especially $C_7$- to $C_{12}$-alkyl side chains, such as n-dodecylbenzene or n-tetradecylbenzene, but in particular with $C_1$- to $C_6$-alkyl side chains, for example n-propylbenzene, isopropylbenzene, ethylmethylbenzenes, trimethylbenzenes, ethyldimethylbenzenes, diethylbenzenes, n-butylbenzene, isobutylbenzene, sec-butylbenzene, tert-butylbenzene, n-pentylbenzene, tert-pentylbenzene, n-hexylbenzene, methylnaphthalenes, di methylnaphthalenes or $C_2$- to $C_6$-alkyl-naphthalenes. All aromatic hydrocarbons mentioned have boiling points above 150° C. at standard pressure, generally in the range of from 156 to 167° C. at standard pressure.

In addition to the aromatic hydrocarbons mentioned with 9 or more carbon atoms, component (iv) may include from 0 to less than 20% by weight of nonaromatic organic solvent components (for example long-chain paraffins and/or alicyclic compounds and/or heterocyclic compounds with boiling points of in each case more than 100° C., in particular more than 130° C.) and/or aromatic solvent components having less than 9 carbon atoms (for example toluene or xylenes). In one embodiment, the aromatic solvent may include a major amount of solvent naphtha and xylene and/or toluene.

Each of the components (A) and (B) described above may contain from about 50 to about 80% by weight of the aromatic solvent based on a total weight of each component.

Component (v)

The amine polymer component (v) of component (B) of the additive composition is a polymeric reaction product of epichlorohydrin with an aliphatic primary monoamine or N-aliphatic hydrocarbyl alkylene diamine. The polymeric reaction products are prepared by heating an amine with eipchlorohydrin in the molar proportions of from 1:1-1.5 in the temperature range of 50 to 100° C. Generally, with aliphatic monoamines, $R^1NH_2$, the molar ratio is about 1:1. The initial reaction product is believed to be an addition product of epichlorohydrin with a primary monoamine. The aminochlorohydrin upon reaction with an inorganic base then forms an aminoepoxide. The aminoepoxide, which contains a reactive epoxide group and a reactive amino-hydrogen, undergoes polymerization to provide a polymeric material containing several amino groups. The ratio of epichlorohydrin to amine and the reaction temperature used are such that the polymeric reaction product contains from 2 to 20 recurring units derived from the aminoepoxide.

The aliphatic primary monoamines that can be used to prepare the polymeric reaction products with epichlorohydrin can be straight chain or branched chain and include, but are not limited to, octylamine, nonylamine, decylamine, undecylamine, dodecylamine, tridecylamine, tetradecylamine, pentadecylamine, hexadecylamine, heptadecylamine, octadecylamine, nonadecylamine, eicosylamine, heneicosylamine, docosylamine, tricosylamine, tetracosylamine and the corresponding alkenyl analogs. The aliphatic primary amine should have at least about 8 carbon atoms, preferably about 12 to 18 carbon atoms to provide polymeric reaction products of sufficient solubility in hydrocarbon fuels. While aliphatic primary amines containing more than about 24 carbon atoms are useful, such amines are of limited availability.

Mixtures of aliphatic primary amines may also be used, and are preferred since mixtures of primary amines derived from tall oil, tallow, soybean oil, coconut oil, cotton seed oil and other oils of vegetable and animal origin are commercially available and at lower cost than individual amines. The above mixtures of amines generally contain alkyl and alkenyl amines of from about 12 to 18 carbon atoms, although sometimes an individual amine mixture, depending upon the source, contains small amounts of primary amines having fewer or more carbon atoms. A preferred example of a commercially available mixture of primary monoamines is hydrogenated tallow amine which contains predominantly hexadecyl- and octadecylamines with smaller amounts of tetradecylamine.

Likewise, N-aliphatic hydrocarbyl alkylene diamines may also be reacted with epichlorohydrin to make component (v). Such diamines include N-octyl, N-nonyl, N-decyl, N-undecyl, N-dodecyl, N-tridecyl, N-tetradecyl, N-pentadecyl, N-hexadecyl, N-heptadecyl, N-octadecyl, N-nonadecyl, N-eicosyl, N-uneicosyl, N-docosyl, N-tricosyl, N-tetracosyl, as well as the corresponding N-alkenyl derivatives of ethylenediamine, propylenediamine, butylenediamine, pentylenediamine and hexylenediamine. The preferred N-aliphatic hydrocarbylalkylenediamine is N-aliphatic hydrocarbyl-1,3-propylenediamine. The N-aliphatic hydrocarbyl-1,3-propylenediamines are commercially available and are readily prepared from aliphatic primary monoamines such as those described above by cyanoethylation with acrylonitrile and hydrogenation of the cyanoethylated amine. Mixtures of N-aliphatic hydrocarbyl-1,3-propylenediamines can also be advantageously used. The preferred mixture is N-tallow-1,3-propylenediamine, wherein "tallow" represents predominantly mixtures of alkyl and alkenyl groups of 16 to 18 carbon atoms which can contain small amounts of alkyl and alkenyl groups of 14 carbon atoms.

The reaction between the amines (as defined above) and epichlorohydrin is advantageously carried out in the presence of a solvent such as benzene, toluene or xylene which may also contain some hydroxylic component such as ethanol, propanol, butanol and the like. After the initial reaction between the amine and epichlorohydrin to form an aminochlorohydrin intermediate, the reaction mass is treated with a strong inorganic base, such as sodium, potassium or lithium hydroxide, to form an aminoepoxide, which under continued heating undergoes polymerization to yield the desired amine polymer product. Inorganic chloride formed in the reaction is removed by filtration. The solvent used to facilitate the reaction can be removed if desired, e.g. by distillation, but generally it is more convenient to use the polymeric polyamine as a solution.

The amount of component (v) in component (B) may range from about 1 to about 10% by weight based on a total weight of component (B).

Component (vi)

Component (B) may optionally contain a quaternary ammonium compound having the general formula:

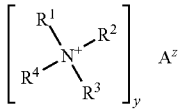

wherein $R^1$ and $R^2$ are the same or different alkyl groups having from 1 to 22 carbon atoms; $R^3$ is selected from the group consisting of alkyl groups having from 1 to 22 carbon atoms and

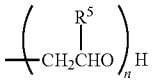

groups wherein $R^5$ is hydrogen or methyl and n is from 1 to 20; and $R^4$ is selected from the group consisting of:

a. an alkyl group having from 1 to 22 carbon atoms;

b. an aralkyl group having from 7 to 22 carbon atoms;

c.

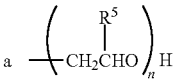

group wherein $R^5$ is hydrogen or methyl and n is from 1 to 20;

d.

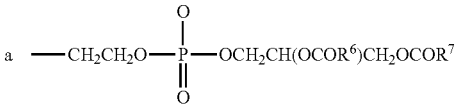

group wherein $R^6$ and R7 are the same or different alkyl groups having from 11 to 19 carbon atoms; and e. an —$R^8$—$CO_2^-$ group wherein $R^8$ is a hydrocarbyl group having from 1 to 17 carbon atoms;

with the proviso that when $R^1$, $R^2$, $R^3$, and $R^4$ are each alkyl groups, at least one of $R^1$, $R^2$, $R^3$ and $R^4$ is an alkyl group having at least 8 carbon atoms; A is an anion; z is 0 or 1 and when $R^4$ is (d) or (e), z is 0; y is at least one and when z is 1, y is numerically equal to the ionic valence of anion A.

Useful quaternary ammonium compounds wherein $R^1$, $R^2$, $R^3$, and $R^4$ are alkyl groups are tetraalkyl ammonium salts. Examples of alkyl radical and aralkyl radicals coming within the definition of $R^1$, $R^2$, $R^3$, and $R^4$ include methyl, ethyl, propyl, isopropyl, butyl, pentyl, hexyl, octyl, nonyl, decyl, undecyl, dodecyl, tridecyl, tetradecyl, pentadecyl, hexadecyl, heptadecyl, octadecyl, eicosyl, docosyl, octadecenyl, octadecadienyl, octadecatrienyl, mixtures of hydrocarbon radicals derived from tall oil, tallow, soy bean oil, coconut oil, cottonseed oil and other oils of vegetable and animal origin as well as aryl-substituted alkyl radicals such as benzyl, phenylethyl, phenylpropyl and the like. The tetraalkyl quaternary ammonium salts are readily available, either commercially or by preparation by art known methods. For example, certain useful tetraalkyl ammonium salts include dimethyldihydrogenated tallow quaternary ammonium chloride, dimethyldisoya quaternary ammonium chloride, dimethyldihydrogenated tallow quaternary ammonium nitrite, dicocodimethyl ammonium quaternary chloride and dicocodimethyl ammonium quaternary nitrite.

The quaternary ammonium compounds are also readily prepared by known procedures, e.g., treating an amine with alkyl halide, aralkyl halide, alkyl sulfate and the like as exemplified by the equation, $RNH_2+3R^1Cl \rightarrow RN(R^1)_3Cl+2HCl$. The starting amine may be a primary amine as exemplified in the above equation, or may be a secondary or a tertiary amine. For convenience, a tertiary amine is usually preferred. The amines useful for the preparation of the quaternary ammonium compounds of the invention are generally available commercially. Particularly useful amines are tertiary amines derived from vegetable and animal oils.

Representative but non-limiting examples of useful tetraalkyl quaternary ammonium salts include in addition to the above-listed dioctadecyldimethyl ammonium chloride, octadecyltrimethyl ammonium chloride, dodecyltrimethyl ammonium chloride, the $C_{12}$-$C_{14}$ alkyl trimethyl ammonium chlorides, the di-$C_{12}$-$C_{14}$ alkyldimethyl ammonium chlorides, hexadecyltrimethyl ammonium bromide, hexadecyltrimethyl ammonium iodide, dioctadecyldimethyl ammonium bromide, dioctadecylmethyl benzyl ammonium chloride, octadecyldimethylbenzyl ammonium chloride, oxtadecyldimethyl(phenylethyl) ammonium chloride and the like. Similarly, nitrites, sulfates, alkylsulfates, phosphates, carboxylates corresponding to the above quaternary ammonium halides may be used. The preferred salt of this type is dicocodimethyl ammonium nitrite wherein "coco" is a mixture of $C_8$-$C_{18}$ alkyl radicals of cocoamine.

The useful quaternary ammonium compounds include those wherein $R^3$ and $R^4$ in the general formula given previously are

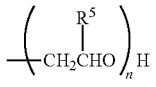

groups, wherein $R^5$ and n are as defined above. These compounds are readily prepared by the reaction of a primary amine with 1,2-alkylene oxide such as ethylene oxide and 1,2-propylene oxide. The number of alkylene oxide units attached to the amine is readily determined by the ratio of the reactants used. As is known in the art, a mixture of alkylene oxides such as that of ethylene oxide and propylene oxide may be used to obtain an amine derivative wherein the polyoxyalkylene group attached to the nitrogen atoms are composed of a random mixture of alkylene oxide units or the condensation reaction may be carried out in steps, whereby the polyoxyalkylene group is derived from one alkylene oxide and by then continuing the reaction with another alkylene oxide to obtain polyoxyalkylene substituent groups in which the polyoxyalkylene units are present as blocks. The amine with the polyoxyalkylene group may be quaternized by reaction with alkyl halides, alkyl sulfate, etc., as described above. In view of the above description, the $R^5$ group may be independently hydrogen or methyl in each of the n units.

The anion, A, of the quaternary ammonium compounds may be any anion of a salt forming acid. Such anions include chloride, bromide, iodide, sulfate, bisulfate, alkylsulfate, arylsulfate, alkanesulfonate, arenesulfonate, nitrate, nitrite, phosphate, monoalkyl phosphate, dialkyl phosphate, monoaryl phosphate, diaryl phosphate, borate, carboxylate and the like. The preferred anions are nitrites.

The quaternary ammonium compounds wherein the $R^4$ group is

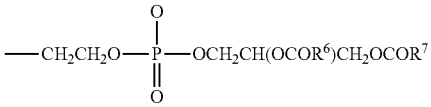

wherein $R^6$ and $R^7$ may be the same or different alkyl groups having from about 11 to 19 carbon atoms are also useful in the present invention. This class of compounds known as phospholipids or lecithins are well known in the art and have been used in petroleum products as non-metallic sludge dispersants in lubricating oils.

The ratio of olefin polysulfone to quaternary ammonium compound may be from about 100:1 to about 1:100, preferably in the range of from about 50:1 to about 1:1, most preferably in the range of from about 20:1 to about 1:1. The most preferred ratios afford compositions which are economical to use, are effective in increasing conductivity and do not adversely affect other desirable characteristics of the hydrocarbon fuels. Accordingly, the amount of quaternary ammonium compound in component (B) may range from about 1 to about 5% by weight based on a total weight of component (B).

When (vi) is present in component (B), component (B) may include a minor amount of aliphatic alcohol having from 2 to 10 carbon atoms. In one embodiment, component (B) includes less than 5 weight percent of a $C_3$ to $C_6$ alcohol such as isopropanol.

The normally liquid hydrocarbon fuels to which the additives are added to render such hydrocarbon fuels electrically conductive are those boiling in the range of about 20 to 375° C. and include such commonly designated fuels as aviation gasoline, motor gasoline, jet fuels, naphtha, kerosene, diesel fuel and distillate burner fuel oil.

Aviation gasoline is a fuel developed specially for aviation engines, especially gasoline engines for propeller aircraft, which is similar to commercial gasoline fuels for operating land vehicles.

Useful gasoline fuels include all commercial gasoline fuel compositions customarily on the market. Gasoline fuel compositions according to WO 00/47698 are also possible fields of use for the present invention. The gasoline fuels mentioned may also further comprise bioethanol.

Useful middle distillate fuels include all commercial diesel fuel and heating oil compositions customarily on the market. Diesel fuels are typically mineral oil raffinates which generally have a boiling range from 100 to 400° C. These are usually distillates having a 95% point up to 360° C. or even higher. They may also be so-called "ultra low sulfur diesel" or "city diesel", characterized by a 95% point of, for example, not more than 345° C. and a sulfur content of not more than 0.005% by weight, or by a 95% point of, for example, 285° C. and a sulfur content of not more than 0.001% by weight. In addition to the diesel fuels obtainable by refining, whose main constituents are relatively long-chain paraffins, suitable diesel fuels are those which are obtainable by coal gasification ["coal to liquid" (CTL) fuels] or gas liquefaction ["gas to liquid" (GTL) fuels]. Also suitable are mixtures of the aforementioned diesel fuels with renewable fuels such as biodiesel. Also suitable are diesel fuels obtained by biomass ["biomass to liquid" (BTL) fuels]. Of particular interest are diesel fuels with a low sulfur content, i.e. with a sulfur content of less than 0.05% by weight, preferably of less than 0.02% by weight, in particular of less than 0.005% by weight and especially of less than 0.001% by weight of sulfur. Diesel fuels may also comprise water, for example in an amount up to 20% by weight, for example in the form of diesel-water microemulsions or as so-called "white diesel".

Heating oils are, for example, low-sulfur or sulfur-rich mineral oil raffinates, or bituminous coal distillates or brown coal distillates, which typically have a boiling range of from 150 to 400° C. Heating oils may be standard heating oil according to DIN 51603-1 which has a sulfur content of from 0.005 to 0.2% by weight, or they are low-sulfur heating oils having a sulfur content of from 0 to 0.005% by weight. Examples of heating oil include in particular heating oil for domestic oil-fired boilers or EL heating oil.

The disclosed additive is particularly useful for the formulation of turbine combustion fuel oils (jet fuels) which are generally those hydrocarbon fuels having boiling ranges within the limits of about 150 to 600° F. (65 to 315° C.) and are designated by such terms as JP-4, JP-5, JP-7, JP-8, Jet A, Jet A-1. JP-4 and JP-5 are fuels defined by U.S. military specification MIL-T-5624-N and JP-8 is defined by U.S. Military Specification MIL-T83133-D. Jet A, Jet A-1 and Jet B are defined by ASTM specification D1655.

The additive composition can be added in any conventional manner. Each individual component of the composition can be added to the hydrocarbon fuel separately or a combined composition of components (A) and (B) can be added as a simple mixture or as a solution in a solvent, such as aromatic solvent, benzene, toluene, xylene, fuel oil, or in a mixture of such solvents. It is convenient to prepare both the polysulfone copolymer and the polymeric polyamine in a solvent, such as one or more of those mentioned above. Thus, it is preferred to use such solutions of polysulfone and polymeric polyamine and to combine them. The combination, which can be termed a concentrate, can then be added to the hydrocarbon fuel. Such concentrate conveniently contains from about 1 to 40% by weight of polysulfone copolymer, from about 1 to 40% by weight of polymeric polyamine and from about 20 to 98% by weight of a solvent or a mixture thereof as described. Preferably, the concentrate will contain from about 5 to 25% by weight of polysulfone copolymer, such as from 10 to 20% by weight, from about 1 to 25% by weight of polymeric polyamine, such as from about 1 to 15% by weight, and from about 50 to 90% by weight of solvent. Accordingly, the fuel will contain from about 0.1 to about 10 mg/L of an additive containing components (A) and (B), such as from about 0.2 to about 8 mg/L, or from about 0.25 to about 5 mg/L of the additive based on a total volume of fuel.

In one embodiment, component (A) may be added to a first fuel in an amount ranging from about 0.25 to about 5 mg/L based on a total volume of the first fuel and component (B) may be added to a second fuel in an amount ranging from about 0.25 to about 5 mg/L based on a total volume of the second fuel. The first fuel and the second fuel may then be combined in a volume ratio of 0.1:1 to 10:1, such as from about 0.25:1 to about 5:1, from about 0.5:1 to about 2:1, or 1:1.

One or more additional optional additives can be present in the compositions disclosed herein. For example, the compositions can contain antifoam agents, dispersants, detergents, antioxidants, thermal stabilizers, carrier fluids, metal deactivators, dyes, markers, corrosion inhibitors, biocides, drag reducing agents, friction modifiers, demulsifiers, emulsifiers, dehazers, anti-icing additives, antiknock additives, surfactants, cetane improvers, corrosion inhibitors, cold flow improvers, pour point depressants, solvents, demulsifiers, lubricity additives, extreme pressure agents, viscosity index improvers, seal swell agents, amine stabilizers, combustion improvers, dispersants, metal deactivators, marker dyes, organic nitrate ignition accelerators, manganese tricarbonyl compounds, and mixtures thereof. In some aspects, the fuel additive compositions described herein can contain about 10 wt. % or less, or in other aspects, about 5 wt. % or less, based on the total weight of the additive or fuel composition, of one or more of the above additives. Similarly, the fuel compositions can contain suitable amounts of fuel blending components such as methanol, ethanol, dialkyl ethers, and the like.

EXAMPLE

The following example is illustrative of exemplary embodiments of the disclosure. In this example as well as elsewhere in this application, all parts and percentages are by weight unless otherwise indicated. It is intended that these example is being presented for the purpose of illustration only and are not intended to limit the scope of the invention disclosed herein.

Conductivities of the test fuels were evaluated according to ASTM 2624 using an EMCEE conductivity meter (Model 1152) having a range of from about 1 to about 2000 picosiemens m−1 (pS/m). All conductivity values were measured within a temperature range of from about 20° C. to about 25° C. All conductivity measurements are in picosiemens m−1 (pS/m), also known as CU or Conductivity Units.

TABLE 1

| Test | Additive treat rate mg/L | Conductivity (pS/m) | Surface Voltage (volts) | Surface Voltage Relaxtion Time (sec) |
|---|---|---|---|---|
| Fuel 1 - Base | 0.0 | 0 | 90821 | 57.19 |
| Fuel 2 - Base with Component (A) | 0.6 | 53 | 703 | 1.1 |

TABLE 1-continued

| Test | Additive treat rate mg/L | Conductivity (pS/m) | Surface Voltage (volts) | Surface Voltage Relaxation Time (sec) |
|---|---|---|---|---|
| Fuel 3 - Base with Component (B) | 0.4 | 55 | −193 | 1.3 |
| Fuel 2 and Fuel 3 Mixed 50/50 | 0.5 | 50 | 42 | 1.1 |

As shown by the results in the above table, the absolute value of the surface voltage is synergistically reduced while conductivity and charge relaxation rates are not affected in the mixture of fuels. It is believed that the synergistic reduction in surface voltage is achieved by mixing two different types of amine polymers together in the presence of a polysulfone. The mixture of polysulfone and amine polymers effectively raises conductivity and increase charge relaxation rates, but also increases the amount of charge generated when a fuel passes through pipes and filters. The magnitude and direction of the charge (i.e. positive or negative) is determined by pipe material, plastic versus metal, inherent fuel properties, and the additives used. Traditional conductivity additives use a polysulfone, 1-decene/$SO_2$, with an epichlorohydrin/tallow diamine polymer, that charge oppositely in fuels. Depending on the amount of component (A) and (B) in the fuel, the fuel can have an overall negative or positive net charge.

The table shows that when you mix the two additives together in fuel the absolute value of the voltage is smaller than when either additive is used alone at the same conductivity level. Conductivity is the industry standard test method for determine if a fuel is safe from electrostatic events. The surface voltage developed in a filling tank though will determine if/when a discharge could occur. Discharges can occur above +1000V or below −1000V. So the additives individually give a 2 order of magnitude improvement over the base fuel, but mixing them together unexpectedly gives another order of magnitude improvement.

It is noted that, as used in this specification and the appended claims, the singular forms "a," "an," and "the," include plural referents unless expressly and unequivocally limited to one referent. Thus, for example, reference to "a dispersant" includes two or more different dispersants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A synergistic conductivity improver additive composition for a distillate fuel said additive composition comprising:

A) a mixture of (i) alkenyl polysulfone polymer, (ii) $C_{16}$-$C_{24}$ α-olefin maleimide copolymer, (iii) sulfonic acid, and (iv) aromatic solvent; and B) a mixture of (i) alkenyl polysulfone polymer, (v) polymeric reaction product of a $C_8$-$C_{18}$ aliphatic amine or diamine with epichlorohydrin; (iii) sulfonic acid, (iv) aromatic solvent; and optionally (vi) a quaternary ammonium compound, wherein the additive composition comprises from 30 to 60 wt. % component (A) and from 30 to 60 wt. % component (B) based on a total weight of the additive composition.

2. The additive composition of claim 1, wherein an amount of (i) in each of components (A) and (B) ranges from about 10 to about 20% by weight based on a total weight of each component.

3. The additive composition of claim 1, wherein an amount of (ii) in component (A) ranges from about 8 to about 15% by weight of a total weight of component (A).

4. The additive composition of claim 1, wherein an amount of (v) in component (B) ranges from about 1 to about 10% by weight of a total weight of component (B).

5. The additive composition of claim 1, wherein an amount of (iii) in each of components (A) and (B) ranges from about 5 to about 15% by weight based on a total weight of each component.

6. The additive composition of claim 1, wherein an amount of (iv) in each of components (A) and (B) ranges from about 50 to about 80% by weight based on a total weight of each component.

7. The additive composition of claim 1, wherein component (B) includes from about 1 to about 5% by weight of (vi) based on a total weight of component (B).

8. The additive composition of claim 1, wherein (iv) comprises a mixture of aromatic solvent.

9. A distillate fuel composition comprising a major amount of distillate fuel and a minor conductivity improving amount of the additive composition of claim 1.

10. The distillate fuel composition of claim 9, wherein the additive composition in the fuel ranges from about 0.25 to about 5 mg/L of a total of components (A) and (B) by weight based on a total volume of the fuel composition.

11. A method for synergistically maintaining an absolute value of surface voltage of a distillate fuel below 1000 volts comprising providing a distillate fuel and adding to the fuel A) from about 0.25 to about 2.5 mg/L by weight based on a total volume of the fuel composition of a mixture of (i) alkenyl polysulfone polymer, (ii) α-olefin substituted maleimide copolymer, (iii) sulfonic acid, and (iv) aromatic solvent; and B) from about 0.25 to about 2.5 mg/L by weight based on a total volume of the fuel composition of a mixture of (i) alkenyl polysulfone polymer, (v) polymeric reaction product of a $C_8$-$C_{18}$ aliphatic amine or diamine with epichlorohydrin; (iii) sulfonic acid, (iv) aromatic solvent; and optionally (vi) a quaternary ammonium compound.

12. The method of claim 11, wherein an amount of (i) in each of components (A) and (B) ranges from about 10 to about 20% by weight based on a total weight of each component, an amount of (iii) in each of components (A) and (B) ranges from about 5 to about 15% by weight based on a total weight of each component, and an amount of (iv) in each of components (A) and (B) ranges from about 50 to about 80% by weight based on a total weight of each component.

13. The method of claim 11, wherein an amount of (ii) in component (A) ranges from about 8 to about 15% by weight of a total weight of component (A), an amount of (v) in component (B) ranges from about 1 to about 10% by weight of a total weight of component (B), and an amount of (vi) in component (B) ranges from about 1 to about 5% by eight of a total weight of component (B).

14. A method for synergistically maintaining an absolute value of surface voltage of a distillate fuel below 1000 volts comprising:

providing a first distillate fuel and adding to the first fuel a fuel additive (A) comprising from about 0.25 to about 5 mg/L by weight based on a total volume of the first fuel composition of a mixture of (i) alkenyl polysulfone polymer, (ii) α-olefin substituted maleimide copolymer, (iii) sulfonic acid, and (iv) aromatic solvent;

providing a second distillate fuel and adding to the second fuel a fuel additive (B) comprising from about 0.25 to about 5 mg/L by weight based on a total volume of the second fuel composition of a mixture of (i) alkenyl polysulfone polymer, (v) polymeric reaction product of a $C_8$-$C_{18}$ aliphatic amine or diamine with epichlorohydrin; (iii) sulfonic acid, (iv) aromatic solvent; and optionally (vi) a quaternary ammonium compound; and mixing the first fuel and the second fuel in a volume ratio of 0.1:1 to 10:1.

15. The method of claim 14, wherein an amount of (i) in each of components (A) and (B) ranges from about 10 to about 20% by weight based on a total weight of each component, an amount of (iii) in each of components (A) and (B) ranges from about 5 to about 15% by weight based on a total weight of each component, and an amount of (iv) in each of components (A) and (B) ranges from about 50 to about 80% by weight based on a total weight of each component.

16. The method of claim 14, wherein an amount of (ii) in component (A) ranges from about 8 to about 15% by weight of a total weight of component (A), an amount of (v) in component (B) ranges from about 1 to about 10% by weight of a total weight of component (B), and an amount of (vi) in component (B) ranges from about 1 to about 5% by eight of a total weight of component (B).

* * * * *